United States Patent [19]

Murakami et al.

[11] Patent Number: 4,470,233

[45] Date of Patent: Sep. 11, 1984

[54] PRESTRESSED TAPERED SLAB STRUCTURE

[75] Inventors: Yoichiro Murakami, Kunitachi; Tatsuo Sato, Tokyo, both of Japan

[73] Assignee: Taisei Kensetsu Kabushiki Kaisha, Tokyo, Japan

[21] Appl. No.: 313,997

[22] Filed: Oct. 21, 1981

[30] Foreign Application Priority Data

Nov. 5, 1980 [JP] Japan ..... 55-154605

[51] Int. Cl.[3] ..... E04B 1/06

[52] U.S. Cl. ..... 52/223 R; 52/250; 52/260

[58] Field of Search ..... 52/73, 80, 250, 251, 52/252, 227, 228, 260, 263, 223 R

[56] References Cited

U.S. PATENT DOCUMENTS

| | | | |
|---|---|---|---|
| 1,392,280 | 9/1921 | Martin | 52/73 |
| 1,536,202 | 5/1925 | Foster | 52/73 |
| 1,851,125 | 3/1932 | MacMillan | 52/252 |
| 3,090,165 | 5/1963 | Chiado | 52/80 |
| 3,114,302 | 12/1963 | Finsterwalder | 52/260 |
| 3,136,092 | 6/1964 | Contini | 52/73 |
| 3,206,895 | 9/1965 | De Ridder | 52/80 |
| 3,380,209 | 4/1968 | Cheskin | 52/223 R |
| 3,383,816 | 5/1968 | Hodson | 52/80 |
| 4,065,897 | 1/1978 | Zezelj | 52/252 |
| 4,137,679 | 2/1979 | Tully | 52/73 |
| 4,320,603 | 3/1982 | Kirschew | 52/80 |

FOREIGN PATENT DOCUMENTS 57-33819 2/1982 Japan .

*Primary Examiner*—John E. Murtagh

*Attorney, Agent, or Firm*—Wenderoth, Lind & Ponack

[57] ABSTRACT

A structure employing a tapered slab, which is formed of a two-dimensional continuous array of upside-down rectangular pyramids with their apexes placed at column centers and their bottom faces placed along an upper surface of a floor slab, is improved in that prestressing steel members are disposed under tension between the top portions of the respective columns and said prestressing steel members are anchored to the columns at the outer ends.

1 Claim, 22 Drawing Figures

PRESTRESSED TAPERED SLAB STRUCTURE

BACKGROUND OF THE INVENTION

1. Field of the Invention

The present invention relates to improvements in a reinforced concrete structure employing a tapered slab, which is formed of a two-dimensional continuous array of upside-down rectangular pyramids with their apexes placed at column centers and their bottom faces placed along an upper surface of a floor slab.

2. Description of the Prior Art

The above-referenced tapered slab was developed to be a replacement for the conventional flat slab as a novel slab adapted for a large span structure and was described in the copending Japanese Utility Model Application No. 55-110229 filed on Aug. 5, 1980. Here, at first, brief description will be made of a structure employing the tapered slab on which this invention is based.

In the proposed tapered slab structure, since the slab is formed of a two-dimensional continuous array of upside-down rectangular pyramids with their apexes placed at column centers and their bottom faces placed along an upper surface of a floor slab and capitals as well as drop panels used in the conventional flat slab structure are eliminated, form work can be completed by merely assembling four large-sized trapezoidal form boards around each column. Hence, form work can be greatly simplified, work for preparing form board can be minimized, a number of reuses of form lumbers is increased, and thus the tapered slab structure is favorable for saving resources.

In the case of considering from a mechanical point of view, the floor slab has such vertical cross-section that it is thinnest at a midpoint between columns and thickest at the opposite ends close to the columns. On the other hand, bending and shearing stresses in the floor slab are concentrated at the end portions close to the columns and become very small at a midpoint between the columns. Consequently, the floor slab consisting of a tapered slab is thick at the end portions close to the columns where stresses are large, and thin at the midpoint between the columns where stresses are small. Hence, the cross-section of the floor slab has a reasonable configuration in view of a cross-sectional efficiency.

Moreover, since the upper surface of the floor slab is a horizontal plane and the lower surface has a pyramid-shaped surface portion with its apex located at a midpoint between columns, the floor slab forms, as a whole, a two way arch, so that a large part of a load is transmitted in the form of axial forces along the surface of the arch, resulting a large reduction of a bending stress in the floor slab, and consequently the amount of reinforcements to be used for the floor slab can be reduced. The above-mentioned arch action has the mechanically most remarkable advantages of the present invention.

Furthermore, the structure employing a tapered slab is deemed to have a cross-sectional shape which is formed by scraping out a lower portion in the middle between columns of a floor slab in the conventional flat slab structure, and so, as compared to the conventional flat slab structure, the dead load is reduced. Hence, bending and shearing stresses of a floor slab are reduced, and this reduction contributes, jointly with the aforementioned arch action, to the saving of the amount of reinforcements.

Still further, in the tapered slab structure, since unevenness normally formed by girders and beams is not present on the lower surface of the floor slab, in the case of utilizing the space between the floor slab and a ceiling extended thereunder as a space for air conditioning, there is an advantage that a flow of air therethrough is smooth and hence an air conditioning efficiency can be enhanced. In addition, even if the level of the ceiling is raised up to the lowest points, that is, the apexes of the lower surface of the floor slab, owing to the existence of the upside-down rectangular pyramids, pyramid-shaped spaces are always left between the ceiling and the floor slab and these spaces can be effectively utilized as ducts. Therefore, a floor height of a building can be reduced and consequently the structural materials can be saved.

As described above, the tapered slab structure has largely contributed to saving the amount of building materials owing to the inherent structural characteristics of the tapered slab. However, in order to effectively utilize the inherent structural characteristics, a reaction force acting upon an arch support for maintaining an arch action must be well controlled.

Although the reaction forces for the respective spans are offset with each other at an inner arch support in a multi-span building because the horizontal components of the reaction forces for the adjacent spans at the inner arch support have the same magnitude and the opposite directions, the reaction forces for the outermost spans in a multi-span building or the reaction forces for the span in a single-span building are directly transmitted to columns, and so, the arch action is eliminated.

SUMMARY AND OBJECTS OF THE INVENTION

It is therefore one object of the present invention to provide a novel tapered slab which can prevent the elimination of an arch action in the outermost spans of a multi-span building or in the span of a single-span building to enable the tapered slab to fully use its structural characteristics.

According to one feature of the present invention, there is provided a prestressed tapered slab structure formed of a two-dimensional continuous array of upside-down rectangular pyramids with their apexes placed at column centers and their bottom faces placed along an upper surface of a floor slab, in which prestressing steel members are horizontally disposed under tension between the top portions of the respective columns and said prestressing steel members are anchored to the columns at the outer ends.

Accordingly in the present invention, since prestressing steel members are horizontally disposed under tension between the top portions of the respective columns within a tapered slab and said prestressing steel members are anchored to the columns at the outer ends, the reaction forces acting upon an arch support can be well controlled by fastening the floor slab between the columns at the outer ends so that the reaction forces may not be directly transmitted to the columns and thus an arch action may not be eliminated, and thereby the structural characteristics of the tapered slab can be fully used.

According to the present invention, owing to the provision of horizontal prestressing steel members under tension between the top portions of the respective columns, not only the reaction forces for the respective spans can be offset, but also shrinkage cracks which may possibly occur in the concrete floor slab, can be effectively prevented because a prestress is introduced in the floor slab by the prestressing steel members. In a tapered slab structure, since the floor slab has such configuration that it is thickened in the peripheries of columns and is thinned out towards a midpoint between columns, shrinkage cracks are liable to occur on the center lines between the columns. However, by fastening the floor slab between the columns at the outer ends by means of the prestressing steel members, a compression force is exerted upon the entire floor slab, and thereby generation of any shrinkage crack can be effectively prevented.

In addition, at the ends of the portion between the columns, a positive statically indeterminate bending moment is caused at an outer edge portion of the floor slab due to the introduction of a prestress by the above-described prestressing steel members, which bending moment serves to offset a negative bending moment caused by the dead load of the floor slab and the live load, and as a result, the amount of reinforcements can be reduced. In the columns also, since the prestressed tapered slab is effective for offsetting a bending moment caused by the weight of the floor slab and the live load, in this respect also the present invention is effective for reducing the amount of reinforcements.

BRIEF DESCRIPTION OF THE DRAWINGS

The above-mentioned and other objects, features and advantages of the present invention will become more apparent by reference to the following description of preferred embodiments of the invention taken in conjunction with the accompanying drawings, wherein.

DETAILED DESCRIPTION OF THE PREFERRED EMBODIMENTS

Figure 1:
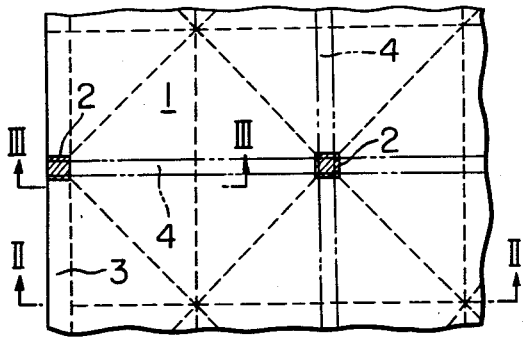
FIG. 1 is a plan view showing one preferred embodiment of a prestressed tapered slab structure according to the present invention.
Figure 2:
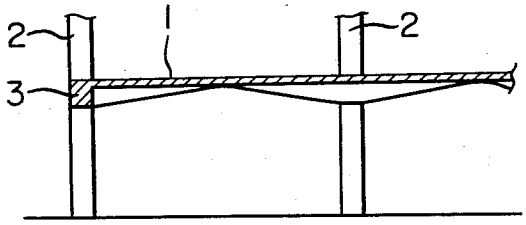
FIGS. 2 and 3 are vertical cross-section views of the structure in FIG. 1 taken along line II—II and line III—III, respectively, in FIG. 1 as viewed in the direction of arrows.
Figure 3:
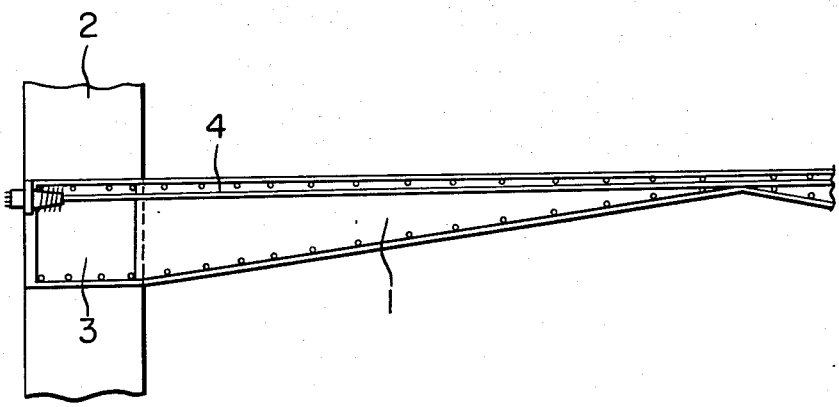
Figure 4:
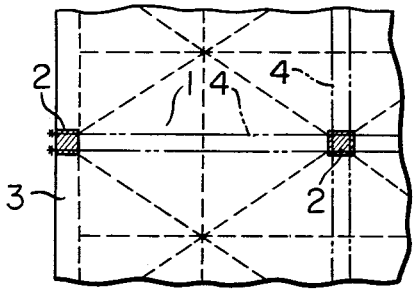
FIGS. 4 through 11 show other preferred embodiments of the present invention, FIGS. 4, 6, 8 and 10 being plan views of different embodiments, and FIGS. 5, 7, 9 and 11 being vertical cross-section views corresponding to FIGS. 4, 6, 8 and 10, respectively.
Figure 6:
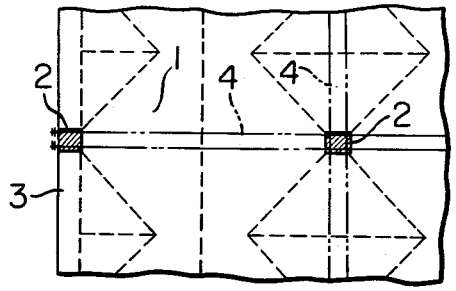
Figure 5:
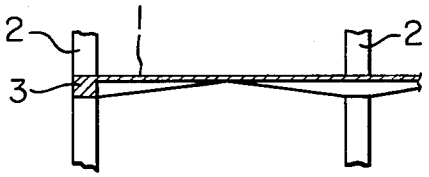
Figure 7:
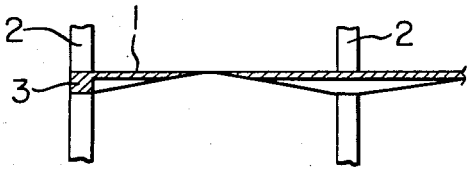
Figure 8:
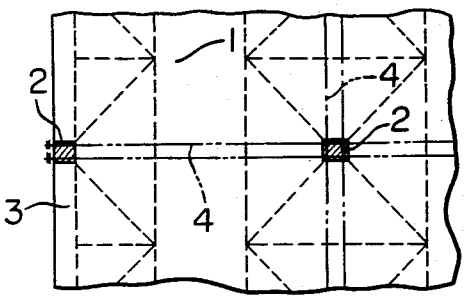
Figure 10:
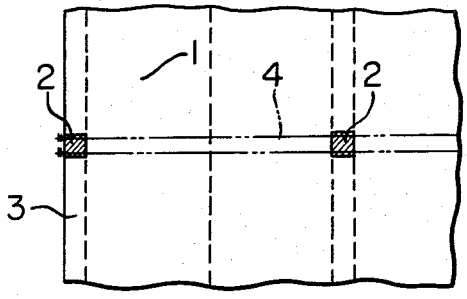
Figure 9:
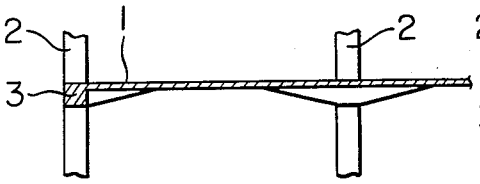
Figure 11:
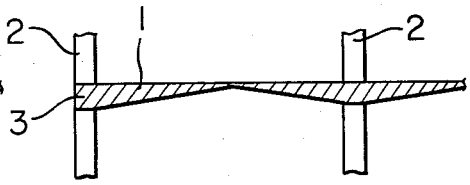

Referring now to FIGS. 1 to 3 of the drawings, reference numeral (1) designates a floor slab, which comprises a tapered slab structure formed of a two-dimensional continuous array of upside-down rectangular pyramids with their apexes placed at column centers (2) and their bottom faces placed along the upper surface of the floor slab (1). In this figure, reference numeral (3) designates an edge beam.

As illustrated in more detail in FIG. 3, a prestressing steel member (4) is disposed horizontally between columns (2), (2) of FIGS. 1 and 2 at such a level that it may be located in the vicinity of the center of thickness at the midpoint between the columns (2), (2), and this prestressing steel member (4) is anchored to the outside of the column (2) as stretched under tension. Under this stretched condition, the opposite end portions of the prestressing steel member (4) are located in the upper portion of thickness of the floor slab (1) at the ends of the slab portion between the columns (2), (2).

By disposing the prestressing steel member (4) in the above-described manner, the reaction forces exerted upon the slab supports by the tapered slab can be well controlled so as to prevent the reaction forces from being directly transmitted to the columns (2), (2), resulting in elimination of an arch action in a tapered slab, and thereby the structural characteristics of the tapered slab can be fully used. In addition, by fastening the floor slab (1) from its opposite sides by means of the prestressing steel member (4), a compression force is exerted upon the entire floor slab (1) and thereby shrinkage cracks can be suppressed.

In addition, by disposing the prestressing steel member (4) slightly below the center level of the floor slab (1) at the midpoint between the columns (2), (2), it effectively counter-acts against a positive bending moment caused in the floor slab (1), and thereby the amount of reinforcements at this portion can be reduced.

Especially, owing to the prestressing steel member (4) disposed at the upper end of thickness of the floor slab (1) at the ends of the slab portion between the columns (2), (2), a positive statically indeterminate bending moment is caused at the ends of the floor slab (1), which bending moment offsets the negative bending moment caused by the weight of the floor slab (1) and the live load, and consequently, the amount of reinforcements to be used for the floor slab (1) can be greatly reduced, and the thickness of the floor slab also can be further reduced.

Moreover, owing to an elevating action of the prestressing steel member (4) due to the elastic deformation thereof, the deformation of the floor slab (1) at its center can be suppressed, so that the magnitude of strain at the center of the floor slab (1) can be easily controlled.

Another characteristic advantage of the proposed structure exists in that, since the cross-section configuration of the floor slab (1) per se has a nonuniform section, the above-mentioned advantages can be obtained by merely disposing the prestressing steel member (4) in a straight configuration. This results in less frictional loss as compared to the conventional prestressed structure in which a prestressing steel member (4) must be disposed in a curved configuration, and hence the amount of prestressing steel members (4) can be reduced by the corresponding amount. Furthermore, with respect to the working also, any special technique for disposing the prestressing steel member (4) is unnecessary because of the straight arrangement of the prestressing steel member (4), and so, the working can be greatly simplified.

FIGS. 4 through 11 show different embodiments of the present invention in which the prestressed tapered slab structure is applied to the structures in which the spans are different between two orthogonal directions. FIGS. 4, 6, 8 and 10 are plan views, while FIGS. 5, 7, 9 and 11 are the corresponding vertical cross-section views, and in these figures, component parts equivalent to those of the first preferred embodiments shown in FIGS. 1 to 3 are given like reference numerals.

Figure 12:
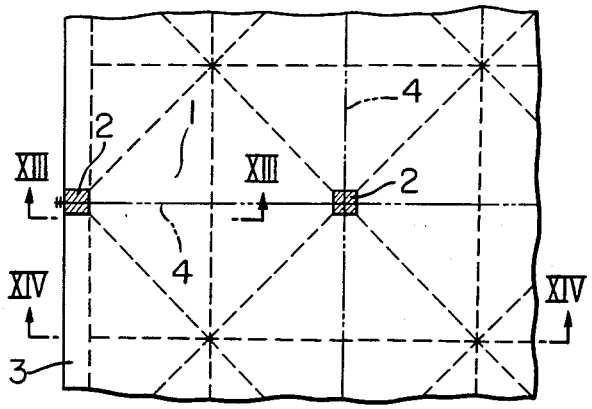
FIG. 12 is a plan view showing a modified embodiment of the present invention in which a prestressing steel member is located below a floor slab.
Figure 13:
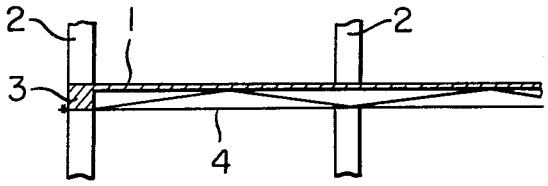
FIGS. 13 and 14 are vertical cross-section views of the structure in FIG. 12 taken along line XIII—XIII and line XIV—XIV, respectively, in FIG. 12 as viewed in the direction of arrows.
Figure 14:
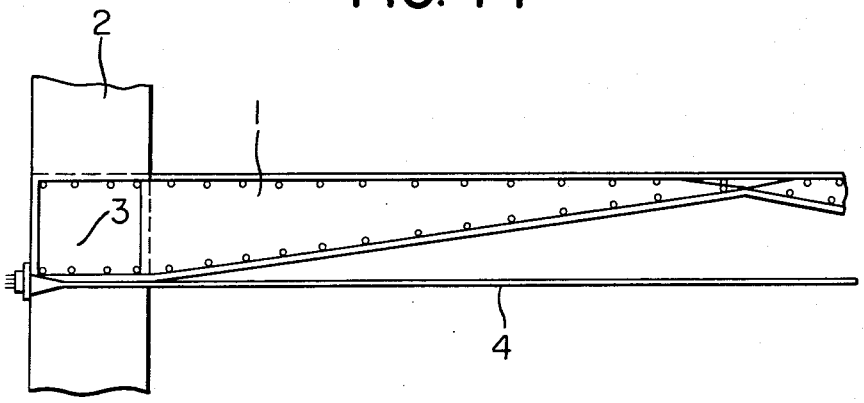
Figure 15:
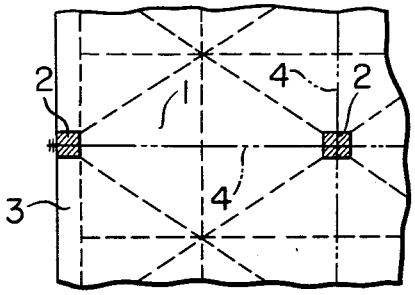
FIGS. 15 through 22 show still further preferred embodiments of the present invention, FIGS. 15, 17, 19 and 21 being plan views of different embodiments, and FIGS. 16, 18, 20 and 22 being vertical cross-section views corresponding to FIGS. 15, 17, 19 and 21, respectively.
Figure 17:
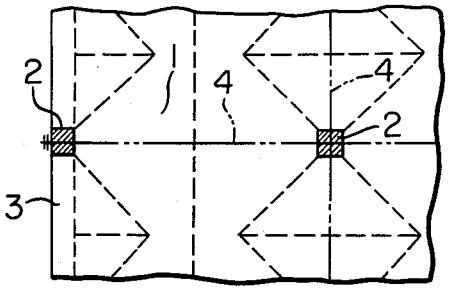
Figure 16:
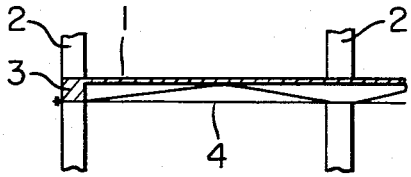
Figure 18:
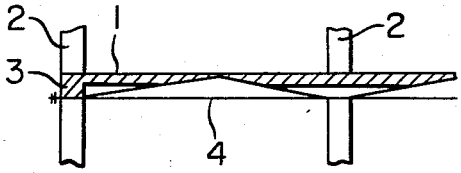
Figure 19:
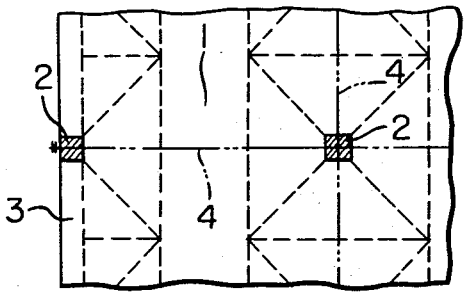
Figure 21:
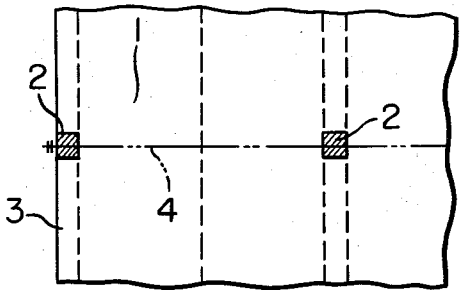
Figure 20:
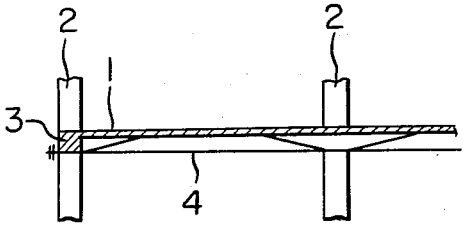
Figure 22:
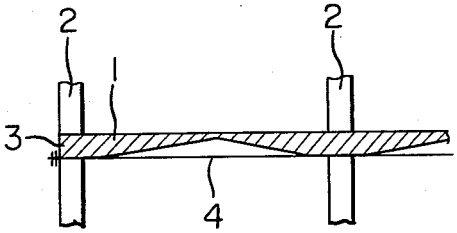

FIGS. 12 to 14 illustrate still another preferred embodiment of the present invention, in which a prestressing steel member (4) is disposed horizontally between columns (2), (2) so as to be located below a floor slab (1), and the prestressing steel member (4) is stretched under tension and fixedly secured to the outside of the column (2). Similarly to the above-described preferred embodiments, the reaction forces acting upon the support by the floor slab (1) can be well controlled shrinkage cracks which may be possibly caused in the floor slab (1) can be effectively prevented by introducing a prestress in the floor slab (1), a positive statically indeterminate bending moment is caused in the end portions between the columns (2), (2) at the outer ends of the floor slab (1) to offset a negative bending moment caused by the weight of the floor slab (1) and the weight of the load, the amount of reinforcements to be used in the floor slab (1) can be reduced, with respect to the column (2) also the amount of reinforcements to be used therein can be reduced by offsetting a bending moment caused by the dead load of the column (2) and the live load, and further, since prestressing steel members (4) are disposed in a straight configuration, the working can be simplified.

Furthermore, according to this modified embodiment, since the prestressing steel member (4) is located below the floor slab (1) and especially a sufficiently large eccentric distance is provided in the vicinity of the midpoint between the columns (2), (2), this structure is especially effective in the event that the positive bending moment at the midpoint between the columns (2), (2) is large, so that a large effect can be achieved with a small force for introducing a prestress, and moreover, this action also can achieve a remarkable effect upon deformation of the floor slab (1) such that the magnitude of strain at the center of the floor slab (1) can be easily controlled by regulating the force for introducing a prestress.

FIGS. 15 through 22 show other preferred embodiments of the present invention in which the invention is applied to a structure in which the spans are different between two orthogonal directions. FIGS. 15, 17, 19 and 21 are plan views of different embodiments, and FIGS. 16, 18, 20 and 22 are vertical cross-section views of the respective embodiments. In these figures, component parts equivalent to those used in the previously described embodiments are given like reference numerals.

While the present invention has been described above in connection with its preferred embodiments, it is intended that, as a matter of course, the invention should not be limited to the illustrated embodiments only, but various changes and modifications in design could be made without departing from the spirit of the present invention.

What is claimed is:

1. A prestressed tapered slab structure comprising:

a two-dimensional continuous array of upside-down rectangular pyramids with their apexes placed at centers of columns and their bottom faces placed along an upper surface of a floor slab, prestressing straight steel rod members disposed under tension transversely between top portions of the respective columns, said prestressing straight steel rod members being anchored to the outside of the columns, and means, fixedly secured to the outer ends of the columns, for stretching the prestressing straight steel rod members under tension so that reaction forces may not be directly transmitted to the columns, shrinkage cracks can be effectively prevented in the floor slab, and a positive bending moment is caused to offset a negative bending moment caused by a dead load of the floor slab and a live load thereon;

wherein said stretching means are located in an upper portion of the floor slab.

* * * * *